United States Patent [19]

Heissner

[11] 4,079,971

[45] Mar. 21, 1978

[54] DOOR-LOCKING ARRANGEMENT

[75] Inventor: Hartmut Heissner, Brunswick, Germany

[73] Assignee: Volkswagenwerk Aktiengesellschaft, Wolfsburg, Germany

[21] Appl. No.: 742,687

[22] Filed: Nov. 17, 1976

[30] Foreign Application Priority Data

Nov. 21, 1975 Germany ..... 2552209

[51] Int. Cl.[2] ..... E05C 3/26

[52] U.S. Cl. ..... 292/216

[58] Field of Search ..... 292/198, 216, 280, DIG. 53, 292/DIG. 26, DIG. 27

[56] References Cited

U.S. PATENT DOCUMENTS 3,504,511 3/1970 Allen ..... 70/241

*Primary Examiner*—Richard E. Moore

*Attorney, Agent, or Firm*—Spencer & Kaye

[57] ABSTRACT

A locking arrangement for a door, particularly a motor vehicle door, which is in the form of a unit mounted on the door and which has a latching element, a locking element which coacts with the latching element, and a spring-biased actuating element which in turn coacts with the locking element. The actuating element has a connecting region that allows a force-transmitting element to be connected to the actuating element. The arrangement of the parts is such that the actuating element has, at least during mounting of the unit on the door, a total range of movement which is greater than the range of movement required for normal operation of the locking arrangement. This greater range of movement allows the actuating element to occupy a position wherein its connecting region is more freely accessible than if the total range of movement of the actuating element were limited to that required for normal operation of the locking arrangement, thus facilitating connecting the force-transmitting element to the connecting region of the actuating element during the mounting operation.

11 Claims, 3 Drawing Figures

III
II
11a
1
2
3
4
7
6
6a
12
11
5
8
10
9
III
II

DOOR-LOCKING ARRANGEMENT

BACKGROUND OF THE INVENTION

The present invention relates to a locking arrangement for a door, particularly a motor vehicle door, which incorporates a unit to be mounted on the door and having a latching element which coacts with a stationary element, a locking element coacting with the latching element, and a spring-biased actuating element which in turn coacts with the locking element. In locks of this type, the actuating element is, during the mounting operation, connected to a force-transmitting element which in turn actuates the actuating element. This force-transmitting element can be in the form of a rod, a pull wire such as a Bowden cable, a remote-control arrangement, a push-button arrangement, a safety device, or the like.

U.S. Pat. No. 3,844,595 issued Oct. 29th, 1974 shows a locking arrangement of the above general type, namely, a locking arrangement which can be mounted, as a unit, onto the outside wall of the door without it being necessary to remove the inner wall of the door. In such locks, the arrangement of the parts must be such that the actuating element which connects with the force-transmitting means leading outside of the lock per se must be sufficiently accessible to allow the force-transmitting means to be detachably connected and this, in turn, makes it necessary for the actuating element to be withdrawn sufficiently far out of the unit so as to permit the connection to be established.

One practical problem that the above entails is that the parts must be so constructed as to provide adequate access to the actuating element of the locking arrangement, so as to make it possible for the force-transmitting means to be connected during the mounting of the lock, and this, as will be explained below, carries with it various difficulties. It is, therefore, a primary object of the present invention to provide a door-locking arrangement which overcomes these difficulties.

BRIEF DESCRIPTION OF THE INVENTION

With the above object in view, the present invention resides in a locking arrangement of the above general type, the construction of which is based on the recognition of the fact that, in principle, the accessibility of the actuating element is of significance primarily, if not exclusively, only during the mounting operation, i.e., at the time the lock is mounted on the door. Accordingly, the present invention resides in a locking arrangement wherein the actuating element has, at least while the unit is in the process of being mounted, a range of movement which is greater than the range of movement required for the normal operation of the locking arrangement, thereby rendering a connecting region of the actuating element more freely accessibile than if the total range of movement of the actuating element were limited to that required for normal operation of the door-locking arrangement, thus facilitating connecting the force-transmitting means to the connecting region of the actuating element.

Thanks to such an arrangement, the lock may be constructed while keeping in mind primarily the requirements incidental to the actual function of the lock, rather than the requirements incidental to its mounting. That is to say, the lock may be constructed in such a way as to meet all of the requirements relating to tolerances, dimensioning, saving of space and the like, all of which cause various difficulties in the design of the lock even if one leaves out of consideration the problems incidental to the mounting of the lock. The latter problems are taken care of by giving the actuating lever a range of movement which, at least during the mounting operation, is greater than that required for normal operation of the lock, so that insofar as various other design and structural factors are concerned, one can concentrate on the requirements which relate to the operation of the lock per se.

BRIEF DESCRIPTION OF THE DRAWINGS

The drawings are three vertical sectional views of one embodiment of a locking arrangement according to the present invention, the same being adapted for remote operation.

DETAILED DESCRIPTION OF THE PREFERRED EMBODIMENT

Figure 1:
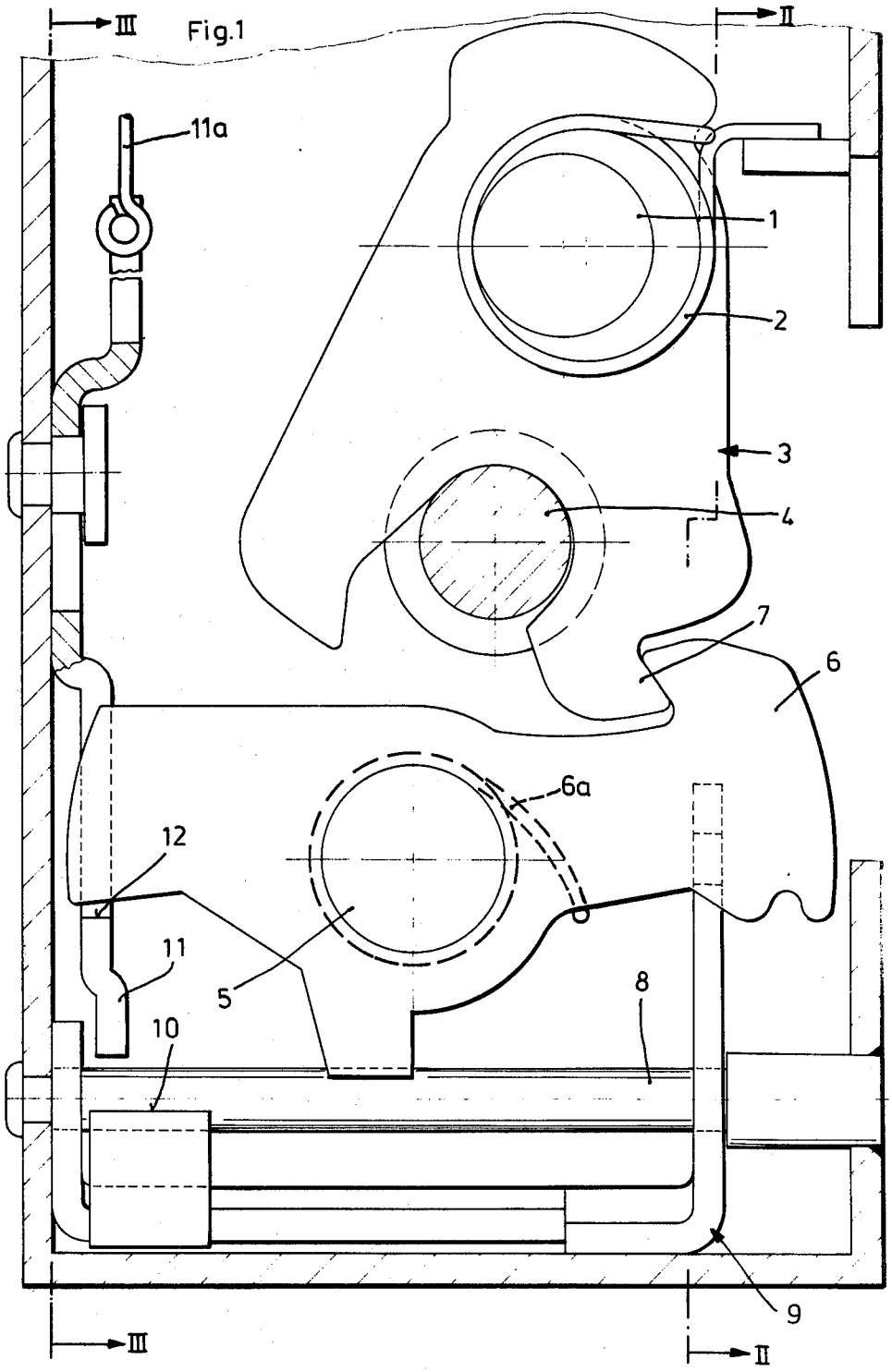
FIG. 1 is a first longitudinal section, as seen in the direction toward the outside wall of the door.

Referring now to the drawings, the same shows a locking arrangement which is connectible, as a unit, to a door, particularly the door of a motor vehicle. The locking arrangement is equipped with a conventional locking element in the form of a rotary catch 3 which is mounted for pivotal movement about an axle 1 and which is biased toward its open position, i.e., a position wherein the door is unlocked, by means of a loop-type spring 2. The rotary catch 3 is provided with a bifurcated region which, when the lock is in its closed position — this being the position depicted in FIG. 1 — embraces a stationary bolt 4 which is attached to the door post or frame, as is likewise conventional. The catch 3 is held in its door-locking position by means of a double-armed lever forming a locking element or pawl 6 which is itself mounted for pivotal movement about a second axle 5 and which is spring-biased by a suitable spring *6a*, such that the right-hand end of the locking pawl 6, as viewed in FIG. 1, extends behind a hook-shaped portion 7 of the catch 3, thereby preventing the catch from pivoting in clockwise direction, again as viewed in FIG. 1, under the influence of the loop-type spring 2 associated with the catch 3.

Figure 2:
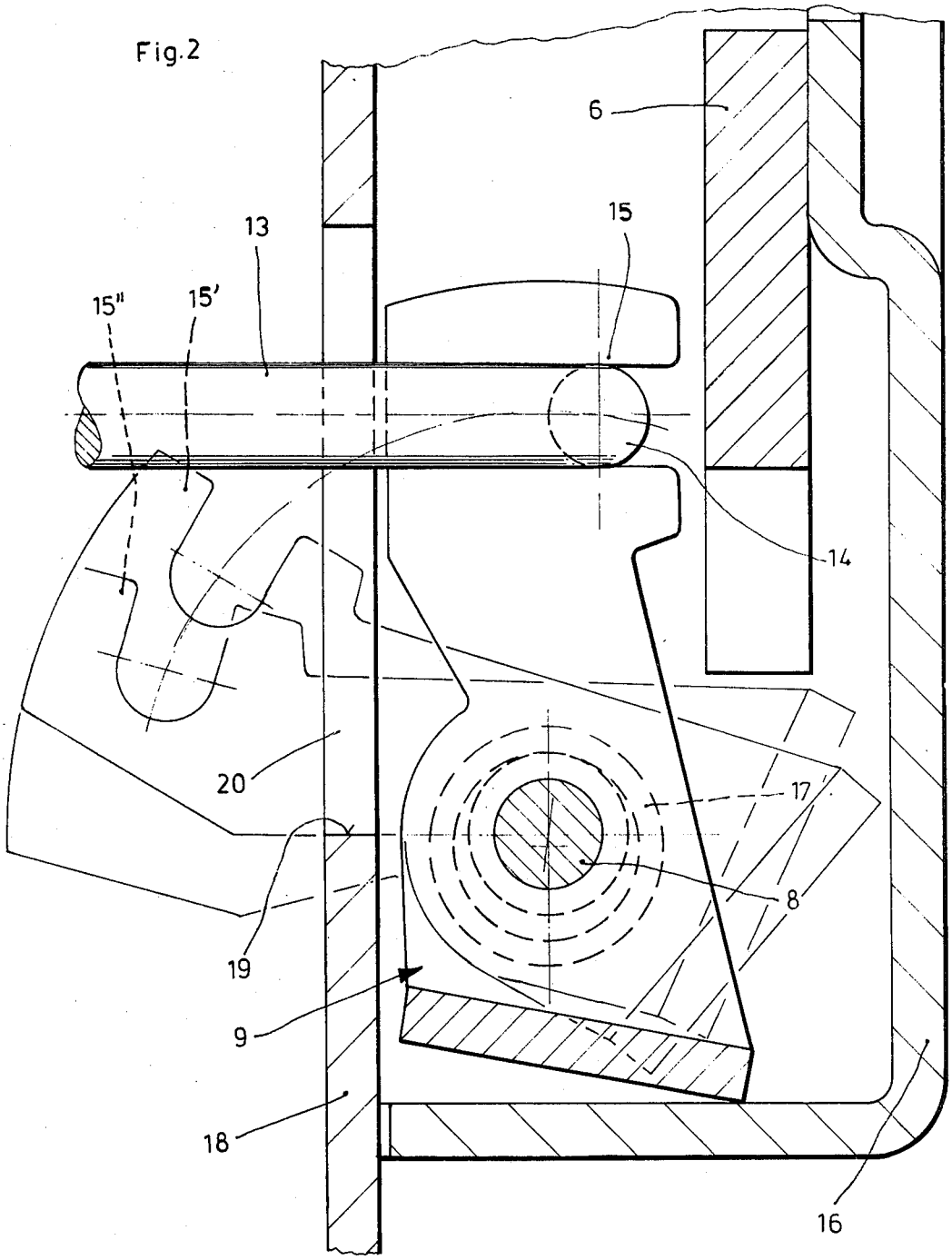
FIG. 2 is a sectional view taken on line II—II of FIG. 1.
Figure 3:
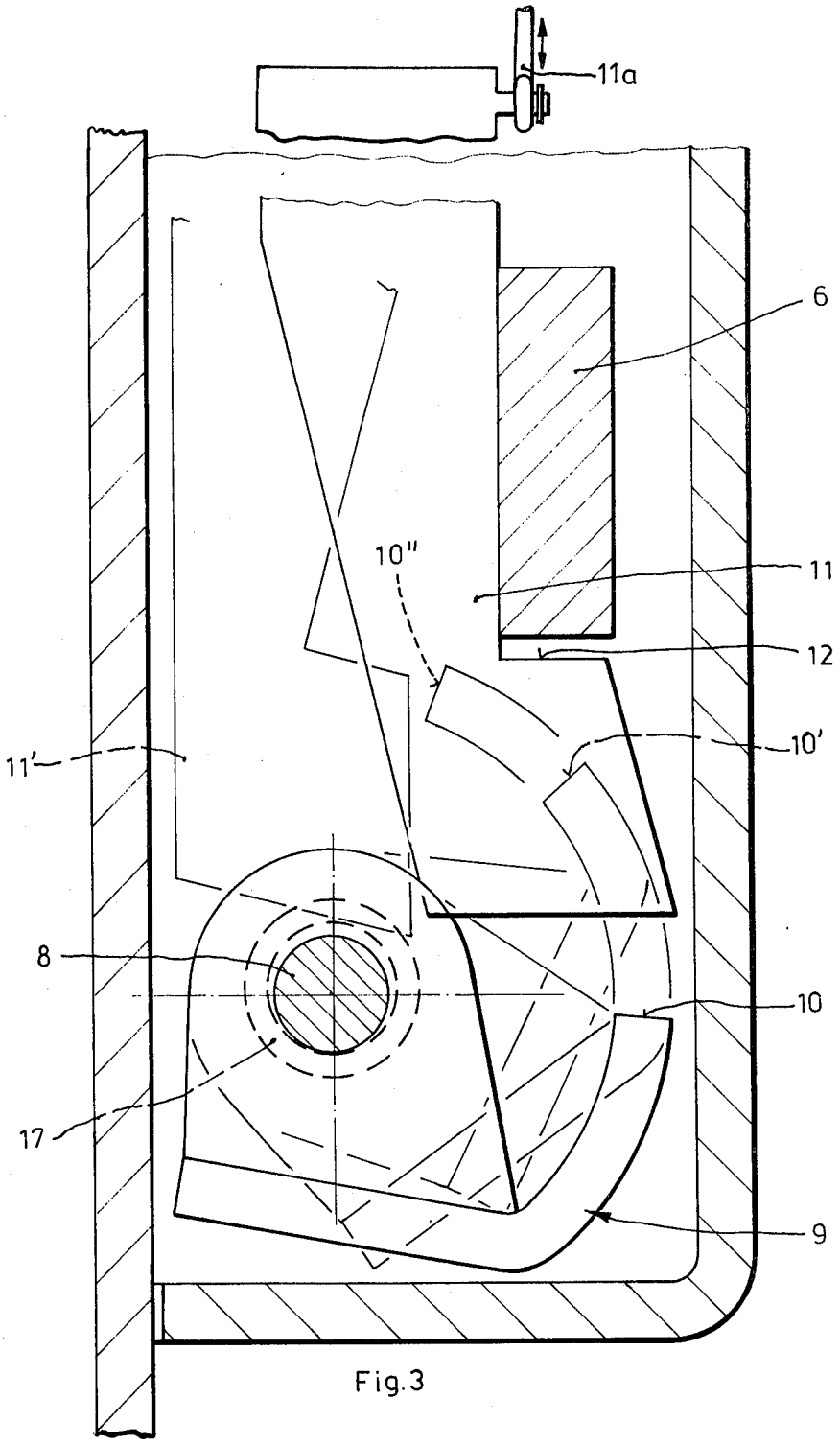
FIG. 3 is a sectional view taken on line III—III of FIG. 1.

Unlocking is effected by means of an actuating element in the form of a lever 9 which is mounted for pivotal movement about a third axle 8, the arrangement of the parts being such that when the actuating lever 9 is pivoted in counter-clockwise direction, as viewed in FIGS. 2 and 3, the edge 10 of the actuating lever 9 will act through the intermediary of the abutment edge 12 of a slide member 11 against the left arm of the locking pawl 6, thereby rotating the locking pawl in clockwise direction, as viewed in FIG. 1. This will cause the right-hand end of the locking pawl 6 to disengage itself from the hook-shaped portion 7 of the catch 3, thereby allowing the latter to pivot in counter-clockwise direction under the influence of the spring 2, and this, in turn unlocks the door.

The pivotal movement of the actuating lever 9 out of its rest position is brought about by exerting a pull on a force-transmitting element which, in the illustrated embodiment, is in the form of a rod 13 having a lug or eyelet-shaped end region 14 which is detachably connected to a connecting region 15 located at the end of actuating lever 9. In the illustrated embodiment, the connecting region is hook-shaped and the end region 14 of the force-transmitting element hangs in this hook-shaped region 15 of the actuating lever 9.

The counterclockwise pivotal movement of the actuating lever 9 — reference being had to the parts as viewed in FIGS. 2 and 3 — which brings about the unlocking of the catch 3 is effected by the force-transmitting element only if the slide 11 is in the position shown in FIG. 3 in solid lines. If, however, the slide is brought into the position 11' shown in phantom lines, for example, by a suitable displacement lever 11*a*, the actuating lever 9 can, as shown in FIG. 3, be swung to such an extent that its abutment edge will reach a position 10' which is beyond the maximum or extreme position required for the normal operation of the lock. This means that the actuating lever 9 can be swung throughout a greater total range so as to reach a third position shown at 10'' which is beyond the actuating position shown at 10' but which is a position wherein the actuating lever 9 has no effect on the pawl 6.

This enlarged range throughout which the actuating lever 9 may be moved, i.e., the range which allows the actuating lever 9 to assume any of the positions depicted generally between 10' and 10'', is provided intentionally and forms a salient feature of the present invention. The purpose of this enlarged range is to allow the connecting region 15 of the actuating lever 9 to be moved into a position wherein it is more readily accessible than if the movement of the actuating element 9 were limited to that required for normal operation of the locking arrangement. This is shown best in FIGS. 2 and 3: when the abutment edge 10 of the actuating lever 9 assumes the position 10'', the hook-shaped connecting region at the end of the actuating lever 9 will occupy the position depicted at 15'', i.e., a position where the connecting region at the end of the actuating lever 9 lies outside of the lock casing 16. This makes the end region freely accessible and facilitates hooking in or otherwise connecting the force-transmitting element 13 to the connecting region of the actuating lever 9. However, as the pivotal movement of the actuating lever 9 is carried out against the force of a spring 17 which coacts with the actuating lever 9 and which biases the same towards its rest position, the latter will, after the element 13 has been hooked in place, be pivoted back, in clockwise direction as viewed in FIGS. 2 and 3, under the influence of the spring associated with the actuating lever 9 unit the actuating lever 9 assumes a position which is commensurate with the normal operation of the lock.

In the illustrated embodiment, means are provided for ensuring that after the door-locking arrangement has been mounted in place, the movement of the actuating lever 9 is limited to that required for normal operation of the arrangement, i.e., movement between its rest position and its actuated position shown at 10 and 10', respectively. This is accomplished by providing the outside wall 18 of the door, which may at the same time serve as the base plate to which the unit incorporating the above-described parts of the door-locking arrangement is attached, with an opening 20 having an edge 19, this edge 19 being so positioned as to form an abutment surface which, after the unit has been mounted to the door, limits movement of the actuating lever 9 to movement between its rest and actuating positions. Specifically, the edge 19 prevents the actuating lever 9 from moving beyond the position shown at 10', 15'.

If desired, the edge 19 may be constituted by a bent-over portion of the piece of sheet metal constituting the outside of the door, or it may be constituted by any other suitable structural means.

It will be seen from the above that thanks to the fact that the total available range of movement of the actuating lever 9 is greater than that required for normal operation of the lock, the connecting region 15 of the actuating lever 9 may be made more freely accessible than if the total range of movement of the actuating element 9 were limited to that required for normal operation, and that this, in turn, facilitates connecting the force-transmitting element to the connecting region 15 of the actuating element 9.

Moreover, it will be appreciated that once the locking arrangement has been mounted, there is no objection to having its range of movement limited to that required for normal operation. As stated above, the spring associated with the actuating lever 9 will serve this purpose, although additional means, such as the abutment 19 which becomes operative after the unit has been mounted, may be provided for ensuring that the range of movement of the actuating lever will be limited to that required for normal operation of the lock.

One additional advantage of the freer accessibility of the connecting region 15 during the mounting operation is that it becomes possible to provide for a better connection between the force-transmitting element and the actuating element. One example of such better connection is the above-described hook-shaped configuration of the end region of the actuating 15 which cooperates with an at least approximately eyelet-shaped connection at the end of the rod 14. The term "at least approximately eyelet-shaped" is intended to include a shape which is not a fully closed eyelet, as, for example, a hook which has a bent-back portion, or a generally U-shaped form. This type of connection is more reliable than other types of connections that are conventionally used in this surrounding. Specifically, a typical prior art lock of the type described here will have the connecting region of the actuating element constituted not by a hook-shaped region but by a simple hole through which passes the connector attached to the force-transmitting element. If this connector is a simple L-shaped element, it can easily slip out of the hole thus making it impossible to operate the lock at all; if the connector carried by the force-transmitting element is U-shaped, it is difficult to insert the connector into the hole, due to the relatively limited accessibility of the hole.

It will be understood that the above description of the present invention is susceptible to various modifications, changes and adaptations, and the same are intended to be comprehended within the meaning and range of equivalents of the appended claims.

What is claimed is:

1. In a locking arrangement for a door, particularly a motor vehicle door, comprising a unit to be mounted on the door, said unit having a latching element which coacts with an element mounted on a column supporting the door, a locking element coacting with the latching element, and a spring-biased actuating lever coacting with the locking element, the actuating lever having a connecting region, the locking arrangement further comprising a force-transmitting element extending in the door outside of the unit, the force-transmitting element being detachably connectable to the actuating lever at the connecting region thereof into a position in which said connecting region of said actuating lever is freely accessible and allows connecting said force-transmitting element to said region of said actuating lever, the improvement that the actuating lever has, at least during mounting of the unit on the door, a range of movement which is greater than the range of movement required for the normal operation of the locking arrangement and throughout which greater range of movement the actuating lever moves against the action of the spring force.

2. A door-locking arrangement having a unit connectible to a door and a force-transmitting element extending in the door generally outside of the unit, said unit comprising:

(a) a latching element movably mounted on the door with which the locking arrangement is associated and adapted to cooperate with a stationary element such that when said latching element engages said stationary element, the door is locked;

(b) a locking element movably mounted on the door and cooperating with said latching element for holding the latter in a position wherein said latching element locks the door; and (c) a spring-biased actuating element mounted on said door and cooperating with said locking element for moving the latter into a position wherein it permits said latching element to unlock the door, said actuating element having a connecting region at which said actuating element may be connected to said force-transmitting element through which said actuating element itself may be actuated, said actuating element being mounted for movement between a rest position toward which said actuating element is spring-biased and an actuating position wherein said actuating element has moved said locking element into its position in which it allows said latching element to unlock the door, and, at least during mounting of the unit, for additional movement between said actuating position and a third position which is beyond said actuating position, in consequence of which the total range of movement of said actuating element, at least during mounting of the unit, is greater than the range of movement of said actuating element required for normal operation of the unit, thereby rendering said connecting region more freely accessible than if the total range of movement of said actuating element were limited to that required for normal operation of the unit, thus facilitating connecting said force-transmitting element to said connecting region of said actuating element.

3. The arrangement defined in claim 2, wherein said locking element is a rotary catch, wherein said locking element is a lever constituting a pawl, and wherein said actuating element is a pivotally mounted lever for causing said pawl to be moved into a position wherein the latter permits said catch to unlock the door.

4. The arrangement defined in claim 2, wherein the force-transmitting element is a component of a remote control arrangement.

5. The arrangement defined in claim 2, wherein said actuating element cooperates with said locking element through the intermediary of a further element in said unit.

6. The arrangement defined in claim 5, wherein said further element is a slide.

7. The arrangement defined in claim 2, wherein the force-transmitting element is a rod.

8. The arrangement defined in claim 7, wherein said connecting region of said actuating lever is hook-shaped and wherein that end of said rod which is connected to said hook-shaped connecting region is at least approximately eyelet-shaped.

9. The arrangement defined in claim 2, adapted for use with the door of a motor vehicle.

10. A door-locking arrangement mountable, as a unit, on a door having an outside wall which is provided with an opening having an edge, the arrangement comprising:

(a) a latching element movably mounted on the door with which the locking arrangement is associated and adapted to cooperate with a stationary element such that when said latching element engages said stationary element, the door is locked;

(b) a locking element movably mounted on the door and cooperating with said latching element for holding the latter in a position wherein said latching element locks the door; and (c) a spring-biased actuating element mounted on said door and cooperating with said locking element for moving the latter into a position wherein it permits said latching element to unlock the door, said actuating element having a connecting region at which said actuating element may be connected to a force-transmitting element through which said actuating element itself may be actuated, said actuating element being mounted for movement between a rest position toward which said actuating element is spring-biased and an actuating position wherein said actuating element has moved said locking element into its position in which it allows said latching element to unlock the door, and, at least during mounting of the door-locking arrangement, for additional movement between said actuating position and a third position which is beyond said actuating position, in consequence of which the total range of movement of said actuating element, at least during mounting of the door-locking arrangement, is greater than the range of movement of said actuating element required for normal operation of the door-locking arrangement, thereby rendering said connecting region more freely accessible than if the total range of movement of said actuating element were limited to that required for normal operation of the door-locking arrangement, thus facilitating connecting the force-transmitting element to said connecting region of said actuating element; said edge of the opening of the door, after the locking arrangement has been attached to the door, forming an abutment surface which limits movement of said actuating element to movement between said rest and actuating positions.

11. A door-locking arrangement connectible, as a unit, to a door, the arrangement comprising:

(a) a latching element movably mounted on the door with which the locking arrangement is associated and adapted to cooperate with a stationary element such that when said latching element engages said stationary element, the door is locked;

(b) a locking element movably mounted on the door and cooperating with said latching element for holding the latter in a position wherein said latching element locks the door;

(c) a spring-biased actuating element mounted on said door and cooperating with said locking element for moving the latter into a position wherein it permits said latching element to unlock the door, said actuating element having a connecting region at which said actuating element may be connected to a force-transmitting element through which said actuating element itself may be actuated, said actuating element being mounted for movement between a rest position toward which said actuating element is spring-biased and an actuating position wherein said actuating element has moved said locking element into its position in which it allows said latching element to unlock the door, and, at least during mounting of the door-locking arrangement, for additional movement between said actuating position and a third position which is beyond said actuating position, in consequence of which the total range of movement of said actuating element, at least during mounting of the door-locking arrangement, is greater than the range of movement of said actuating element required for normal operation of the door-locking arrangement, thereby rendering said connecting region more freely accessible than if the total range of movement of said actuating element were limited to that required for normal operation of the door-locking arrangement, thus facilitating connecting the force-transmitting element to said connecting region of said actuating element; and (d) means, operative after mounting of the unit, for limiting the range of movement of said actuating element to movement between said rest and actuating positions.

* * * * *